US009808809B2

(12) United States Patent
Ueda et al.

(10) Patent No.: US 9,808,809 B2
(45) Date of Patent: Nov. 7, 2017

(54) DUST COLLECTOR, ELECTRODE SELECTION METHOD FOR DUST COLLECTOR, AND DUST COLLECTION METHOD

(71) Applicant: MITSUBISHI HEAVY INDUSTRIES MECHATRONICS SYSTEMS, LTD., Kobe-shi, Hyogo (JP)

(72) Inventors: Yasutoshi Ueda, Tokyo (JP); Katsuhisa Kojima, Tokyo (JP); Kazutaka Tomimatsu, Hyogo (JP); Masaya Kato, Hyogo (JP); Takao Tanaka, Hyogo (JP)

(73) Assignee: MITSUBISHI HITACHI POWER SYSTEMS ENVIRONMENTAL SOLUTIONS, LTD., Kanagawa (JP)

( * ) Notice: Subject to any disclaimer, the term of this patent is extended or adjusted under 35 U.S.C. 154(b) by 115 days.

(21) Appl. No.: 14/764,976

(22) PCT Filed: Feb. 7, 2013

(86) PCT No.: PCT/JP2013/052909
§ 371 (c)(1),
(2) Date: Jul. 30, 2015

(87) PCT Pub. No.: WO2014/122756
PCT Pub. Date: Aug. 14, 2014

(65) Prior Publication Data

US 2015/0360235 A1 Dec. 17, 2015

(51) Int. Cl.

| | |
|---|---|
| ***B03C 3/47*** | (2006.01) |
| ***B03C 3/011*** | (2006.01) |
| ***B03C 3/41*** | (2006.01) |

(52) U.S. Cl.
CPC ..... *B03C 3/47* (2013.01); *B03C 3/011* (2013.01); *B03C 3/41* (2013.01); *B03C 2201/10* (2013.01)

(58) Field of Classification Search
CPC combination set(s) only.
See application file for complete search history.

(56) References Cited

U.S. PATENT DOCUMENTS 2,700,429 A * 1/1955 Wintermute ..... B03C 3/36 55/DIG. 31
3,958,962 A * 5/1976 Hayashi ..... B03C 3/08 96/97

(Continued)

FOREIGN PATENT DOCUMENTS

CN 2573904 Y 9/2003
CN 1698969 A 11/2005

(Continued)

OTHER PUBLICATIONS

Kazuhiro Suginami, "Filter-type electric dust collector", Industrial Machinery, May 2010, pp. 35-38.

(Continued)

*Primary Examiner* — Duane Smith
*Assistant Examiner* — Sonji Turner
(74) *Attorney, Agent, or Firm* — Kanesaka Berner and Partners LLP

(57) ABSTRACT

The purpose of the present invention is to provide a dust collector, an electrode selection method for a dust collector, and a dust collection method such that it is possible to select a suitable wire mesh to be used in a collecting electrode and thereby improve the collecting efficiency even at high flow velocities. A dust collector has a discharge electrode to which a voltage is applied, and a collecting electrode that is disposed facing the discharge electrode and has a planar member formed of a wire mesh, wherein the wire mesh of (Continued)

the planar member satisfies equations <1> and <2> below, and the gas face velocity (v) of the gas penetrating the wire mesh is v=0.1 m/s or higher. <1> IndexT=(the inter-wire distance÷2)÷the opening ratio÷the wire diameter×the gas face velocity <2> IndexT≤2.

4 Claims, 12 Drawing Sheets

(56) References Cited

U.S. PATENT DOCUMENTS

| | | | | |
|---|---|---|---|---|
| 3,999,964 | A * | 12/1976 | Carr | B03C 3/155 55/499 |
| 4,056,372 | A * | 11/1977 | Hayashi | B03C 3/41 96/87 |
| 5,466,279 | A * | 11/1995 | Hattori | B03C 3/12 29/25.01 |
| 5,557,923 | A | 9/1996 | Bolt et al. | |
| 5,593,476 | A * | 1/1997 | Coppom | B03C 3/155 95/78 |
| 5,695,549 | A * | 12/1997 | Feldman | B03C 3/0175 95/80 |
| 5,855,653 | A * | 1/1999 | Yamamoto | B03C 3/155 96/58 |
| 7,465,338 | B2 * | 12/2008 | Kurasek | B03C 3/09 95/75 |
| 7,862,650 | B2 * | 1/2011 | Dooley | B03C 3/09 96/67 |
| 2004/0139854 | A1 | 7/2004 | Rittri et al. | |
| 2004/0149132 | A1 * | 8/2004 | Pasic | B03C 3/09 96/84 |
| 2007/0000236 | A1 | 1/2007 | Naito et al. | |
| 2011/0171094 | A1 * | 7/2011 | Zahedi | B01D 53/323 423/245.1 |
| 2011/0209620 | A1 | 9/2011 | Nazuka et al. | |

FOREIGN PATENT DOCUMENTS

| | | | |
|---|---|---|---|
| CN | 1791468 | A | 6/2006 |
| JP | 7-853 | A | 1/1995 |
| JP | 8-500521 | A | 1/1996 |
| JP | 10-501175 | A | 2/1998 |
| JP | 2001-17884 | A | 1/2001 |
| JP | 2001-321693 | A | 11/2001 |
| JP | 2006-83751 | A | 3/2006 |
| JP | 2007-117968 | A | 5/2007 |
| JP | 2009-131795 | A | 6/2009 |
| JP | 2009-165974 | A | 7/2009 |
| JP | 2009-178626 | A | 8/2009 |
| JP | 2010-115618 | A | 5/2010 |
| JP | 2013-123692 | A | 6/2013 |

OTHER PUBLICATIONS

Ueda et al., "Mobile Net Electrostatic Precipitator for Dry Electrostatic Precipitator Backup", Mitsubishi Heavy Industries Technical Review, vol. 38 No. 1, 2001,pp. 36-39.

International Search Report dated Apr. 9, 2013 in International Application No. PCT/JP2013/052909.

Office Action in CN Application No. 201380070137.8, dated May 4, 2016.

Office Action in JP Application No. 2014-560595, dated Aug. 16, 2016.

Extended European Search Report in EP Application No. 13874423.0, dated Aug. 23, 2016.

* cited by examiner

DUST COLLECTOR, ELECTRODE SELECTION METHOD FOR DUST COLLECTOR, AND DUST COLLECTION METHOD

RELATED APPLICATIONS

The present application is a National Phase of International Application Number PCT/JP2013/052909, filed Feb. 7, 2013.

TECHNICAL FIELD

The present invention relates to a dust collector, an electrode selection method for a dust collector, and a dust collection method.

BACKGROUND ART

Exhaust gas containing dust (particulate material, for example), SOx, and the like is generated due to combustion at industrial combustion facilities such as coal- or heavy oil-fired power generation plants, incinerators, and the like. An exhaust gas treatment facility is installed in a flue located on the downstream side of such a combustion facility in order to discharge the exhaust gas to the atmosphere after removing the dust, SOx, and the like from the exhaust gas.

A wet-type desulfurization equipment, a dust collector, or the like is provided in the exhaust gas treatment facility. The wet-type desulfurization equipment uses magnesium hydroxide ($Mg(OH)_2$) as adsorbing material, for example, and supplies the adsorbing material to the exhaust gas using a spray. As a result of the SOx being adsorbed by the adsorbing material, the SOx is removed from the exhaust gas.

In order to remove the dust, the dust collector is provided with a discharge electrode that causes the particulate material to be electrically charged and a collecting electrode that is disposed facing the discharge electrode. As a result of corona discharge being generated by the discharge electrode, the particulate material contained in the exhaust gas is ionized. Then, the ionized particulate material is collected by the collecting electrode.

Patent Literature 1 discloses, in order to reliably collect the particulate material, a technology in which an ion wind is used to accelerate the particulate material in a direction perpendicular to a gas flow inside a casing, and then, the particulate material is collected by a collecting electrode that has a predetermined opening ratio that allows the ion wind to penetrate.

CITATION LIST

Patent Literature

Patent Literature 1: Japanese Unexamined Patent Application Publication No. 2007-117968A

SUMMARY OF INVENTION

Technical Problem

Although a gas face velocity of a bag filter is from 1 to 2 m/min, it is required that the bag filter have a gas face velocity of not less than 0.1 m/sec to reduce the size of the bag filter. When only a wire mesh is used, the collecting performance is better when the mesh is finer. Meanwhile, when the discharge electrode and the wire mesh are used in combination, as the collecting performance significantly changes in accordance with the specification of wire mesh, it has been necessary to check operating conditions in accordance with the wire mesh.

The present invention is made in light of the foregoing, an object of the present invention is to provide a dust collector, an electrode selection method for a dust collector, and a dust collection method that are capable of selecting a suitable wire mesh to be used in a collecting electrode and of improving the collecting efficiency even at high flow velocities.

Solution to Problem

A dust collector according to the present invention includes a discharge electrode configured to have a voltage applied thereto and a collecting electrode having a planar member formed of a wire mesh and disposed facing the discharge electrode.

The wire mesh of the planar member satisfies equations (1) and (2) below, and a gas face velocity v of penetrating the wire mesh is such that v=not less than 0.1 m/s:

$$\text{Index}T=(\text{inter-wire distance}\div 2)\div\text{opening ratio}\div\text{wire diameter}\times\text{gas face velocity}, \quad (1)$$

$$\text{Index}T\leq 2 \quad (2).$$

According to this configuration, when, for example, exhaust gas containing particulate material is introduced, as a result of corona discharge being generated by the discharge electrode, the particulate material contained in the exhaust gas is ionized, and the ionized particulate material is collected by the collecting electrode. Equation (1) corresponds to a required horizontal dust migration velocity at a time when the particulate material approaches one of wires in the horizontal direction, between two of the wires of the wire mesh. Here, the required horizontal dust migration velocity is a velocity required for the particulate material to adhere to the wire mesh.

At this time, as a result of the wire mesh satisfying the equations (1) and (2), wire surfaces of the wire mesh in the planar member of the collecting electrode have suitable conditions for the particulate material to adhere thereto, and collecting efficiency of the collecting electrode is improved.

In the above-described invention, the dust collector may further include a filter material that is disposed on a surface side of the collecting electrode opposite to a surface of the collecting electrode facing the discharge electrode.

According to this configuration, as a result of the filter material being further provided, the overall collecting efficiency can be improved.

An electrode selection method for a dust collector according to the present invention is the electrode selection method for the dust collector that includes a discharge electrode configured to have a voltage applied thereto and a collecting electrode having a planar member formed of a wire mesh and disposed facing the discharge electrode. The electrode selection method includes the step of performing a selection of a wire mesh so that the wire mesh of the planar member satisfies equations (1) and (2) below, and a gas face velocity v of penetrating the wire mesh is such that v=not less than 0.1 m/s:

$$\text{Index}T=(\text{inter-wire distance}+2)\div\text{opening ratio}\div\text{wire diameter}\times\text{gas face velocity}, \quad (1)$$

$$\text{Index}T\leq 2 \quad (2).$$

A dust collection method according to the present invention includes the step of collecting particulate material using a dust collector. The dust collector includes a discharge electrode configured to have a voltage applied thereto and a collecting electrode having a planar member formed of wire mesh and disposed facing the discharge electrode. The wire mesh of the planar member satisfies equations (1) and (2) below, and a gas face velocity v of penetrating the wire mesh is such that v=not less than 0.1 m/s:

$$\text{Index}T=(\text{inter-wire distance}+2)\div\text{opening ratio}\div\text{wire diameter}\times\text{gas face velocity}, \quad (1)$$

$$\text{Index}T\leq 2 \quad (2).$$

Advantageous Effects of Invention

According to the present invention, selecting a suitable wire mesh to be used in a collecting electrode allows the collecting efficiency to be improved even at high flow velocities.

DESCRIPTION OF EMBODIMENTS

Figure 1:
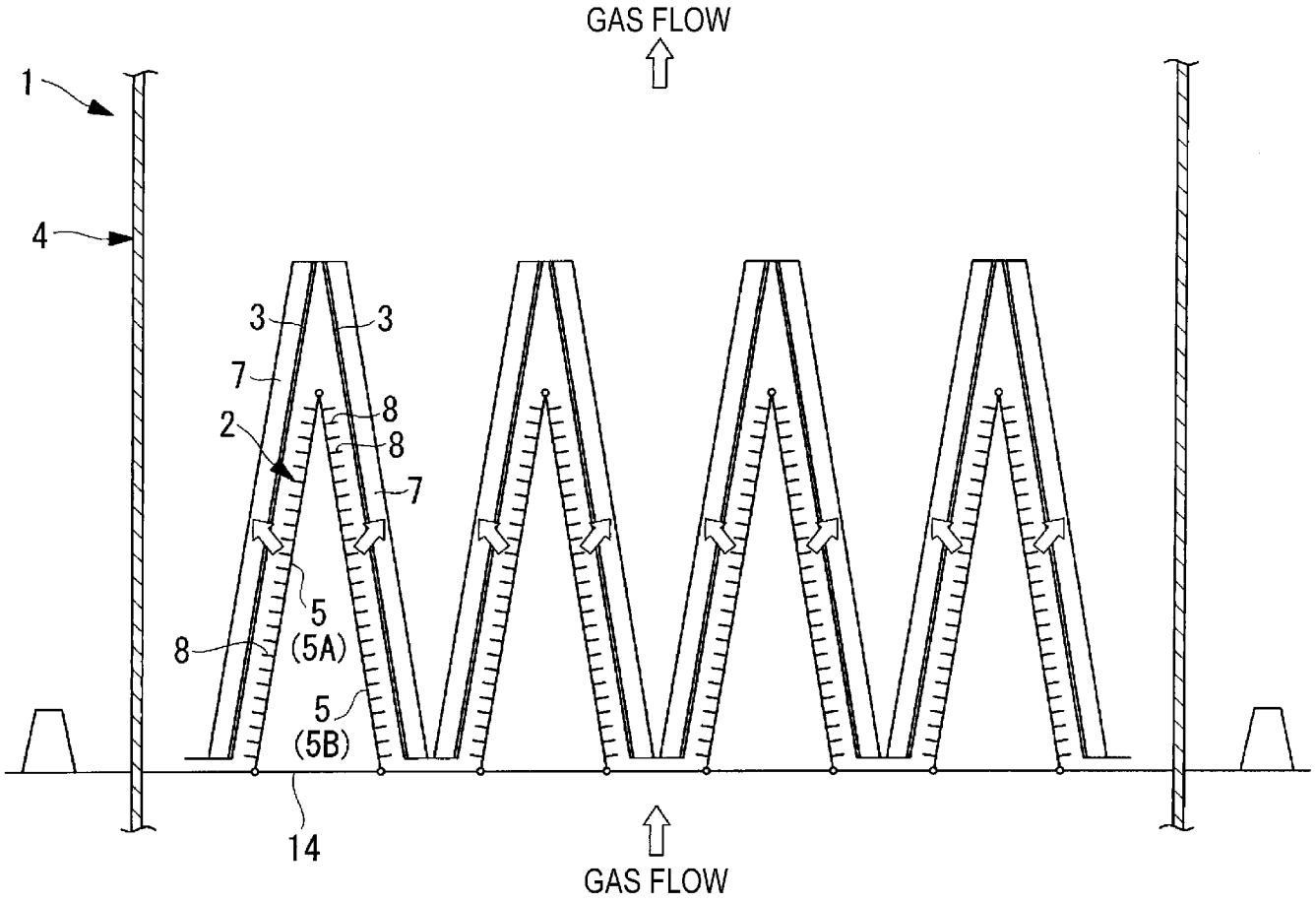
FIG. 1 is a vertical cross-sectional view illustrating a dust collector according to an embodiment of the present invention.

A configuration of a dust collector 1 according to an embodiment of the present invention will be described below with reference to FIG. 1 and FIG. 2.

The dust collector 1 according to the present embodiment is, for example, installed in an exhaust gas treatment facility, which is provided inside a flue located on the downstream side of an industrial combustion facility such as a coal- or heavy oil-fired power generation plant or an incinerator. Further, the dust collector 1 can be also used for a filter for air cleaning facilities (an air conditioning filter for a clean room, a filter for removing a virus, and the like, for example), and the like as well as for the industrial combustion facilities.

The dust collector 1 includes a discharge electrode 2 that causes particulate material to be electrically charged and a collecting electrode 3 that is disposed facing the discharge electrode 2 in order to remove the particulate material, such as dust and mist. The discharge electrode 2 and the collecting electrode 3 are disposed inside a casing 4.

The discharge electrode 2 has a mounting frame 5 and a discharge spike 8. The discharge spike 8 is disposed on the mounting frame 5 so as to form a spiny shape from the mounting frame 5 toward the collecting electrode 3.

The mounting frame 5 is inclined with respect to a gas flow of an inlet portion. An upstream portion of the gas flow of the dust collector 1 is positioned on a lower side in the gravity direction and a downstream side of the gas flow is positioned on an upper side in the gravity direction. The mounting frame 5 is formed of two mounting frames 5A and 5B combined with each other and self-stands on a discharge electrode support member 14. More specifically, the two mounting frames 5A and 5B support the load of each other on the downstream side of the gas flow. The two mounting frames 5A and 5B are disposed so that a gap therebetween on the upstream side of the gas flow becomes wider than that on the downstream side of the gas flow. The two mounting frames 5A and 5B are disposed with the gap therebetween widened on the upstream side of the gas flow so that a space velocity becomes from 1 m/s to 4 m/s, for example. In an example illustrated in FIG. 1 and FIG. 2, a shape formed by a plurality of mounting frames 5A and 5B combined with each other is a triangular prism. A bottom portion of the triangular prism is open on the upstream side of the gas flow, and the mounting frames 5A and 5B are provided on side surfaces of the triangular prism.

The collecting electrode 3 has a planar member 6 formed of a wire mesh and is disposed facing the discharge electrode 2.

In the collecting electrode 3, the planar member 6 is inclined with respect to the gas flow of the inlet portion. The collecting electrode 3 is formed of two sheets of the planar members 6 combined with each other and self-stands on the support member. The two sheets of the planar members 6 support the load of each other on the downstream side of the gas flow. The two sheets of the planar members 6 are disposed so that a gap therebetween on the upstream side of the gas flow becomes wider than that on the downstream side of the gas flow.

Although the collecting electrode 3 is positioned above the discharge electrode 2 so as to cover the discharge electrode 2, the discharge electrode 2 and the collecting electrode 3 are separated and electrically insulated from each other.

Figure 2:
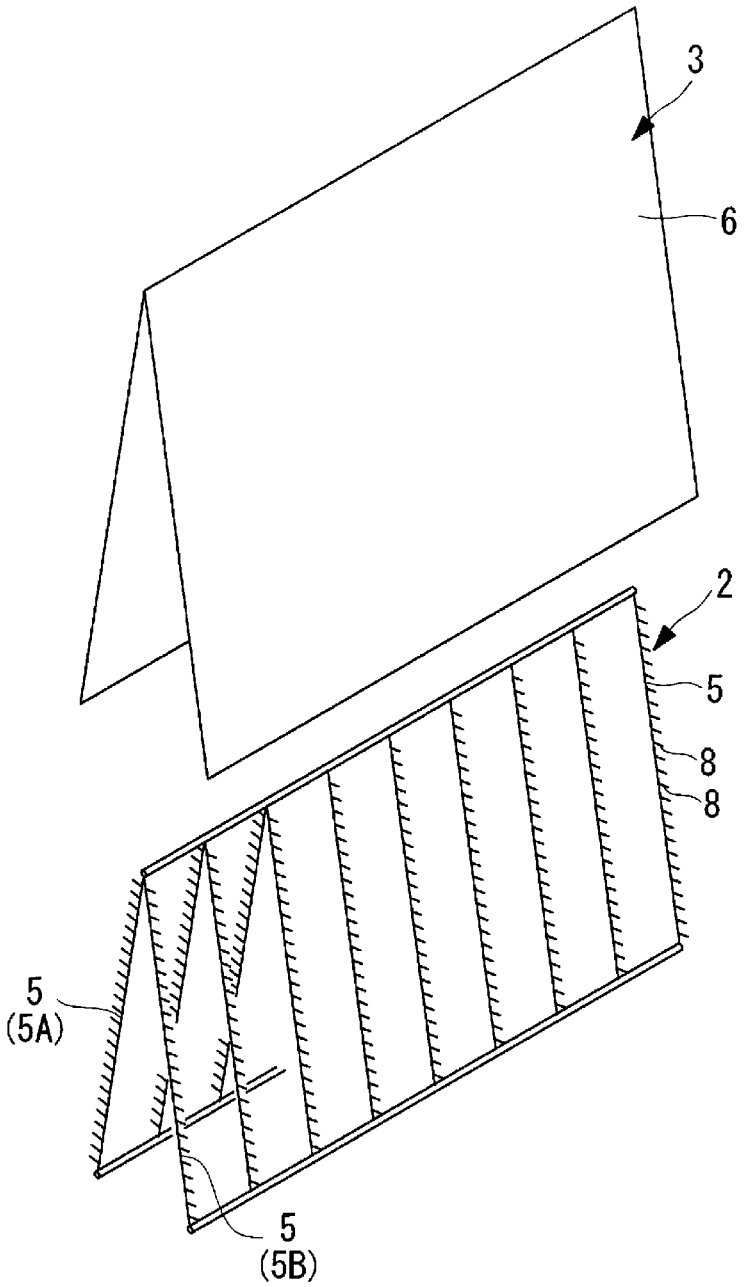
FIG. 2 is an exploded perspective view illustrating a discharge electrode and a collecting electrode according to the embodiment of the present invention.

Note that, although an example has been described in the embodiment illustrated in FIG. 1 in which the mounting frame 5 and the planar member 6 self-stand in the vertical direction with respect to an installation surface of the dust collector 1, the present invention is not limited to this example. The mounting frame 5 and the planar member 6 may be disposed in a direction parallel to the installation surface of the dust collector 1, that is, the horizontal direction, and the mounting frame 5 and the planar member 6 may be fixed to the discharge electrode support member 14 in the cantilever manner.

The discharge electrode 2 is connected to a high voltage power supply (not illustrated in the drawings) via an insulator (not illustrated in the drawings) fixed to the casing 4. As a result of the high voltage being applied to the discharge electrode 2, corona discharge is generated by the discharge electrode 2. The corona discharge causes the particulate material contained in the exhaust gas to be ionized. Then, the ionized particulate material is collected by the collecting electrode 3.

The dust collector 1 further includes a filter material 7 that is disposed on a surface side of the collecting electrode 3 opposite to a surface of the collecting electrode facing the discharge electrode 2. The filter material 7 is a so-called middle efficiency particulate air filter, or the like. As a result of the filter material 7 being further provided, it is possible to improve the overall collecting efficiency of the dust collector 1. Note that it is desirable that the filter material 7 have a specification that provides a finer mesh than that of the wire mesh. A material property of the filter material 7 is not particularly limited.

According to the present embodiment, when the exhaust gas containing the particulate material, for example, is introduced from the inlet portion of the casing 4, as a result of the corona discharge being generated by the discharge electrode 2, the particulate material contained in the exhaust gas is ionized, and the ionized particulate material is collected by the collecting electrode 3. Further, as the two mounting frames 5 of the discharge electrode 2 support the load of each other on the downstream side of the gas flow and the two mounting frames 5 are disposed so that the gap therebetween on the upstream side of the gas flow is wider than that on the downstream side of the gas flow, the discharge electrode 2 can self-stand, being supported only from below and there is no need to support the discharge electrode 2 on an upper side thereof. Further, as the two mounting frames 5 are inclined with respect to the flow direction of the gas flow and the gap therebetween on the upstream side of the gas flow is wider, it is possible to suppress an increase of a flow velocity in a gas inflow portion.

Further, according to the present embodiment, as the planar member 6 of the collecting electrode 3 is inclined with respect to the gas flow of the inlet portion, the ionized particulate material reliably penetrates the collecting electrode 3, regardless of being on the upstream side or the downstream side of the gas flow.

As the two sheets of the planar members 6 of the collecting electrode 3 support the load of each other on the downstream side of the gas flow and the two sheets of the planar members 6 are disposed so that the gap therebetween on the upstream side of the gas flow is wider than that on the downstream side of the gas flow, the planar members 6 can self-stand, being supported only from below, and there is no need to support the planar members 6 on an upper side thereof. Further, as the two sheets of the planar members 6 are inclined with respect to the flow direction of the gas flow and the gap therebetween on the upstream side of the gas flow is wider than that of the downstream side, it is possible to suppress an increase of the flow velocity in the gas inflow portion.

Note that, although an example has been described in the above-described embodiment in which a shape in the vertical cross section of the mounting frame 5 of the discharge electrode 2 and a shape in the vertical cross section of the planar member 6 of the collecting electrode 3 are triangular, the present invention is not limited to this example. The shape in the vertical cross section of the mounting frame 5 of the discharge electrode 2 and the shape in the vertical cross section of the planar member 6 of the collecting electrode 3 may be polygonal (trapezoidal, pentagonal, or the like, for example) other than triangular, for example.

Note that configurations of the discharge electrode 2 and the collecting electrode 3 are not limited to the above-described shapes. More specifically, the discharge electrode 2 and the collecting electrode 3 do not have to be inclined with respect to the gas flow direction, but may be disposed in parallel with the gas flow direction.

Next, the wire mesh which is applied to the collecting electrode 3 of the dust collector 1 will be described.

Generally speaking, the flow velocity of the dust collector 1 is faster than that of the bag filter, which has the flow velocity of approximately 1 m/min or less, and is approximately 6 m/min (0.1 m/sec) or more. Thus, when the wire mesh having a predetermined opening ratio is used for the collecting electrode 3 of the dust collector 1, the collecting efficiency may be reduced depending on a shape of the opening of the wire mesh, a wire diameter of the wire mesh, and the like.

As a result of earnest investigation by the inventors into a selection of the wire mesh having good collecting efficiency, the following knowledge has been obtained. By using the wire mesh that satisfies predetermined conditions based on the knowledge obtained by the inventors as the collecting electrode 3, it is possible to improve the collecting efficiency of the dust collector 1.

The behavior of the particulate material (dust, mist, and the like, and hereinafter also simply referred to as "dust"), which penetrates the wire mesh, at a time when the particulate material penetrates wires 10 of the wire mesh will be described below.

An actual horizontal dust migration velocity is considered to be constant, regardless of specifications of the wire mesh and the gas flow velocity. This is because the Coulomb force generated by charge is also constant when the field intensity (=charge voltage/distance) is constant. Specification items of the wire mesh include a weaving method, such as plain weaving, twill weaving, and plain dutch weaving, an inter-wire distance, a wire diameter, and the like.

Figure 3:
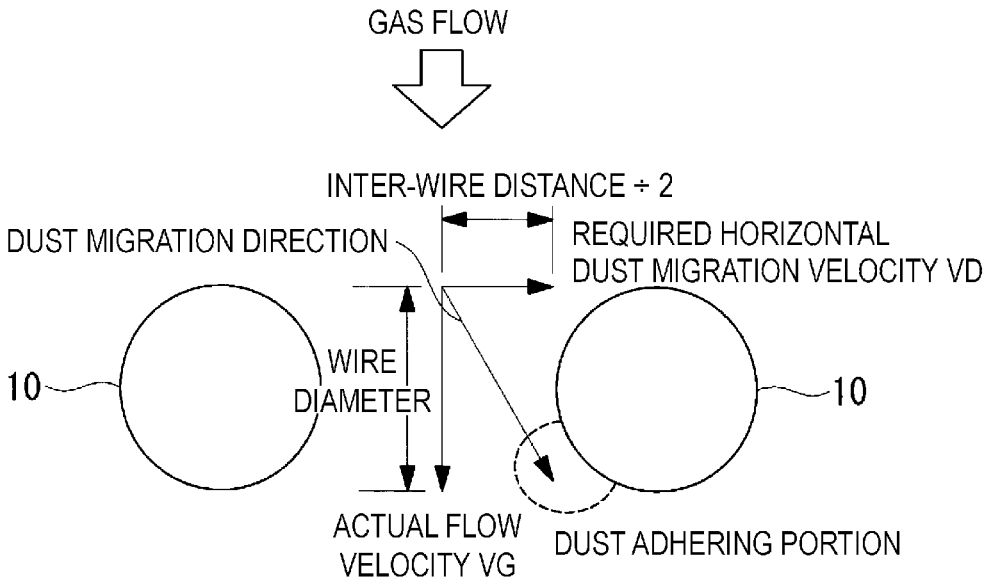
FIG. 3 is a schematic cross-sectional view illustrating two wires of a wire mesh.

A required horizontal dust migration velocity, which differs depending on a type of each wire mesh, can be calculated with reference to FIG. 3. The required horizontal dust migration velocity is a velocity required for the dust to penetrate a dust adhering portion and to adhere to the wire mesh. The horizontal direction is a direction parallel to a direction of connecting the wires 10.

The required horizontal dust migration velocity is expressed by the following equation:

Required horizontal dust migration velocity=((inter-wire distance÷2)×actual flow velocity)÷wire diameter, where actual flow velocity=gas face velocity÷opening ratio.

Figure 5:
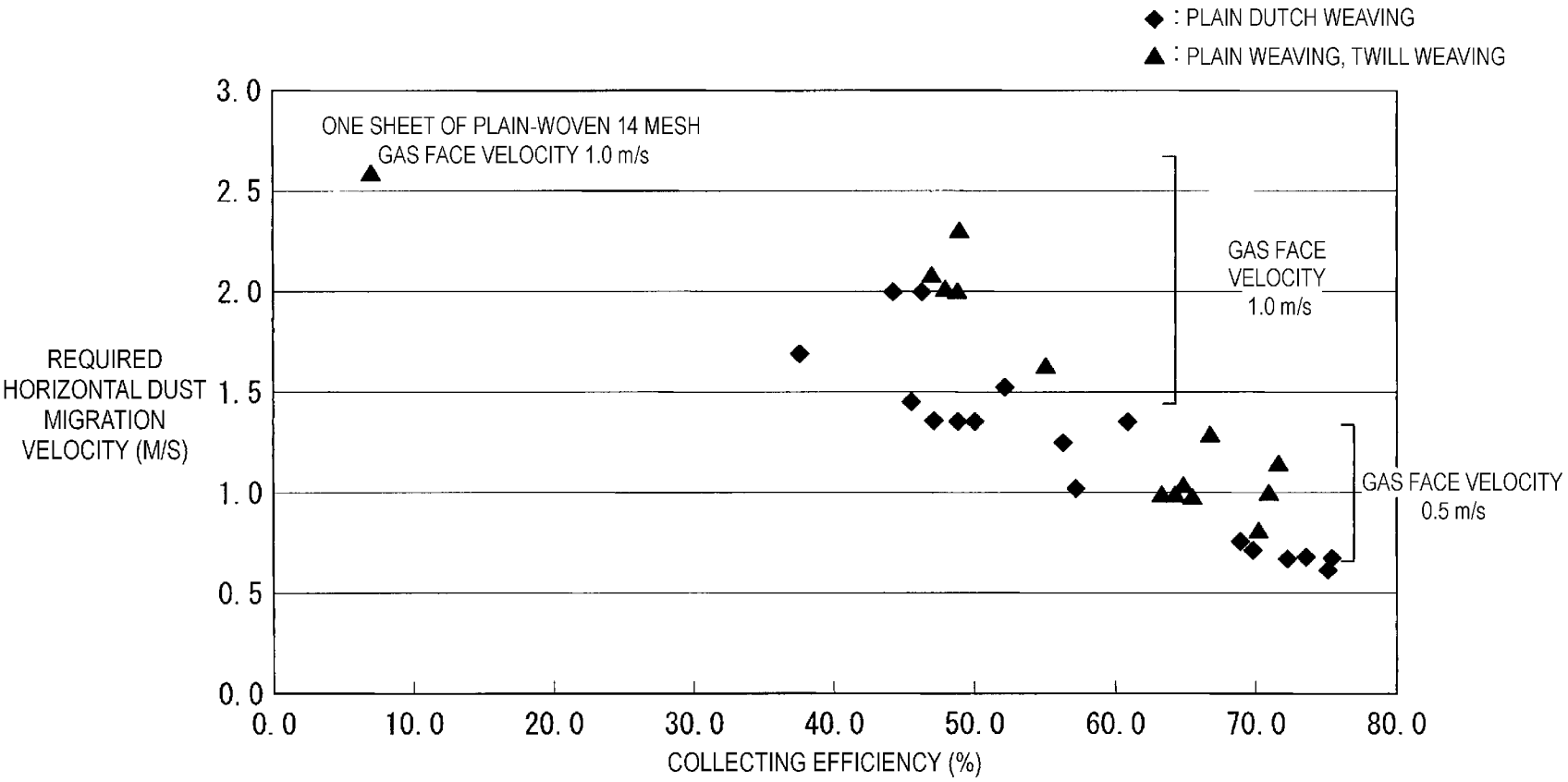
FIG. 5 is a graph showing a relationship between a required horizontal dust migration velocity and collecting efficiency.

A graph in FIG. 5 shows a relationship between the required horizontal dust migration velocity and the collecting efficiency of each of various types of wire meshes when the dust is collected using the wire meshes in the dust collector 1

According to this graph, the collecting efficiency is significantly reduced when one sheet of a plain-woven 14 mesh is used at the gas face velocity of 1.0 m/s. Thus, it can be estimated that the actual horizontal dust migration velocity is from not less than 2.2 m/s and less than 2.6 m/s. More specifically, when the one sheet of the plain-woven 14 mesh is used at the gas face velocity of 1.0 m/s, the horizontal dust migration velocity of 2.6 m/s is required. In this case, as the horizontal dust migration velocity which is faster than the actual horizontal dust migration velocity (not less than 2.2 m/s and less than 2.6 m/s) is required, it can be said that most of the dust does not adhere to the wires 10 of the wire mesh, but penetrates the wires 10.

Figure 4:
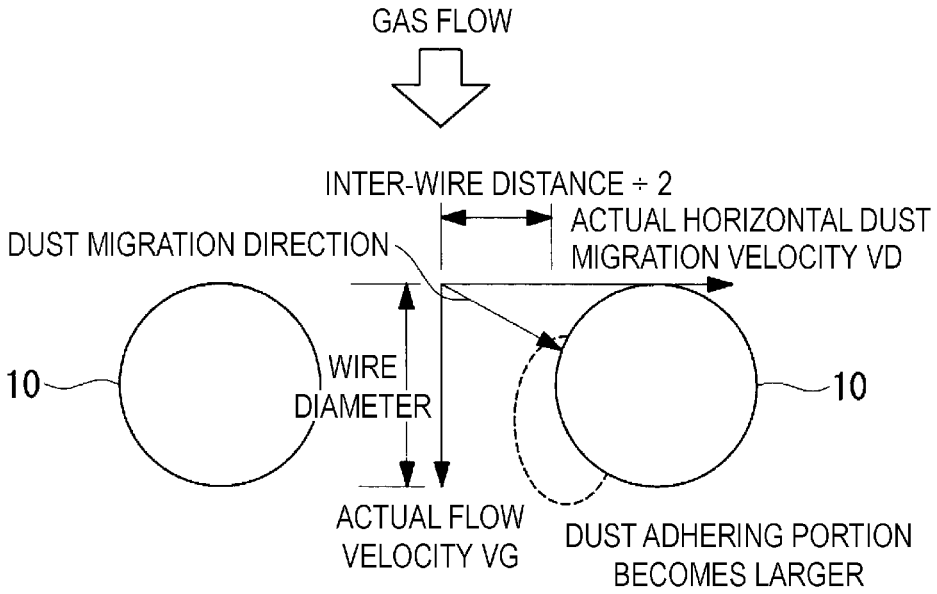
FIG. 4 is a schematic cross-sectional view illustrating the two wires of the wire mesh.

Thus, based on the graph shown in FIG. 5, it can be understood that collecting efficiency is enhanced when the wire mesh is used that has a smaller required horizontal dust migration velocity which is calculated based on a shape of the wire mesh and the gas face velocity than actual horizontal dust migration velocity. It can be estimated that this is because there is a greater area in the wire diameter of the wire to which the dust adheres (see FIG. 4).

According to the above-described knowledge, it can be said that the collecting efficiency can be estimated as long as the required horizontal dust migration velocity is obtained based on the shape and the gas face velocity of each wire mesh. In an example shown in FIG. 5, a threshold value of the required horizontal dust migration velocity is from not less than 2.2 m/s and less than 2.6 m/s, and the smaller the value of the required horizontal dust migration velocity is, the better the collecting efficiency becomes.

Figure 6:
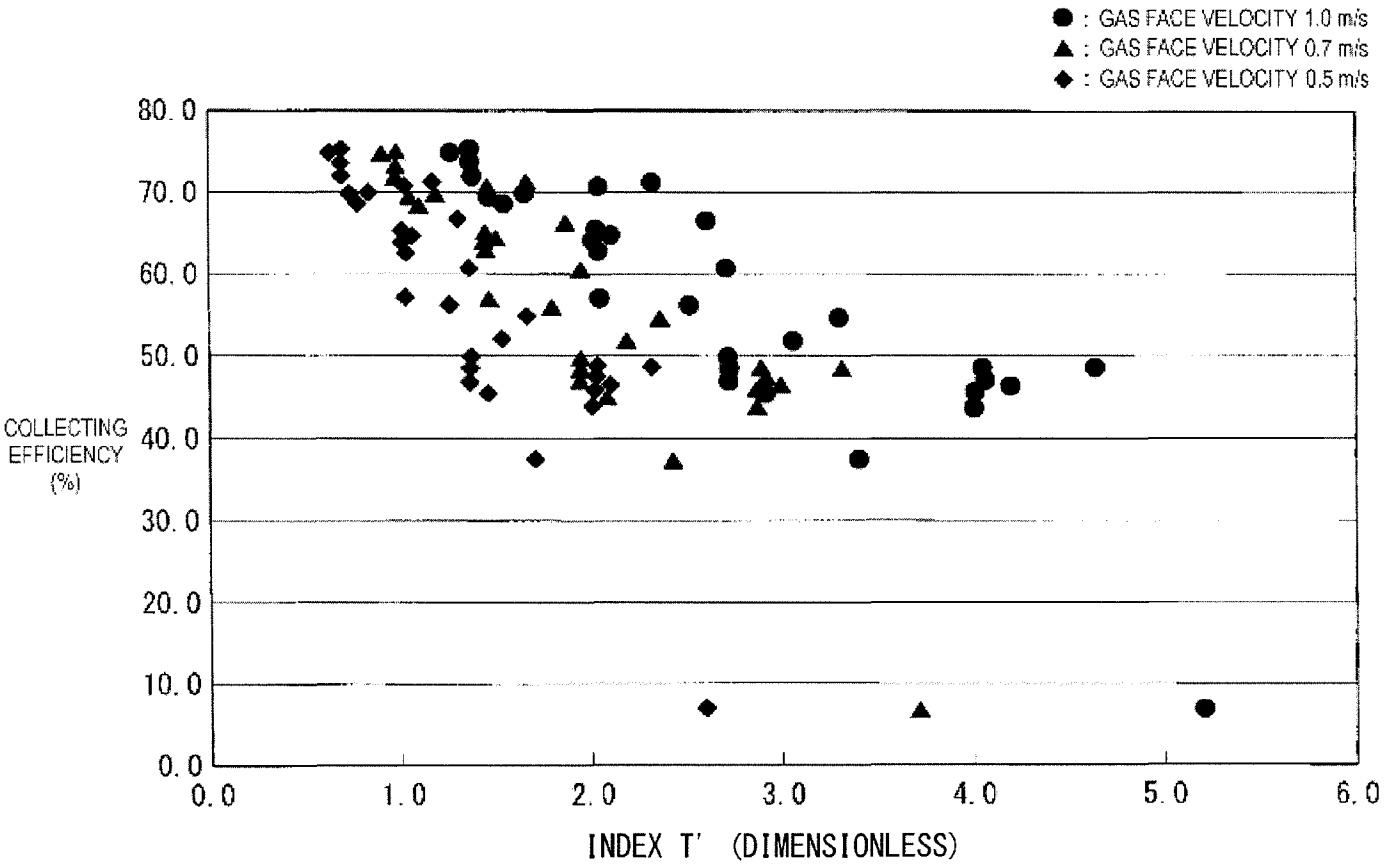
FIG. 6 is a graph showing a relationship between the collecting efficiency and IndexT'.

The above-described equation can also be expressed as follows: Required horizontal dust migration velocity=((inter-wire distance=2) opening ratio)=wire diameter×gas face velocity. Therefore, the required horizontal dust migration velocity is proportional to the gas face velocity. Thus, when a relationship between the collecting efficiency and IndexT' (non-dimensional) is plotted on a graph in accordance with different surface velocities, a graph shown in FIG. 6 is obtained. Here, IndexT' can be expressed by the following equation:

$$\text{Index}T'=(\text{inter-wire distance}\div 2)\div\text{opening ratio}\div\text{wire diameter.}$$

Figure 7:
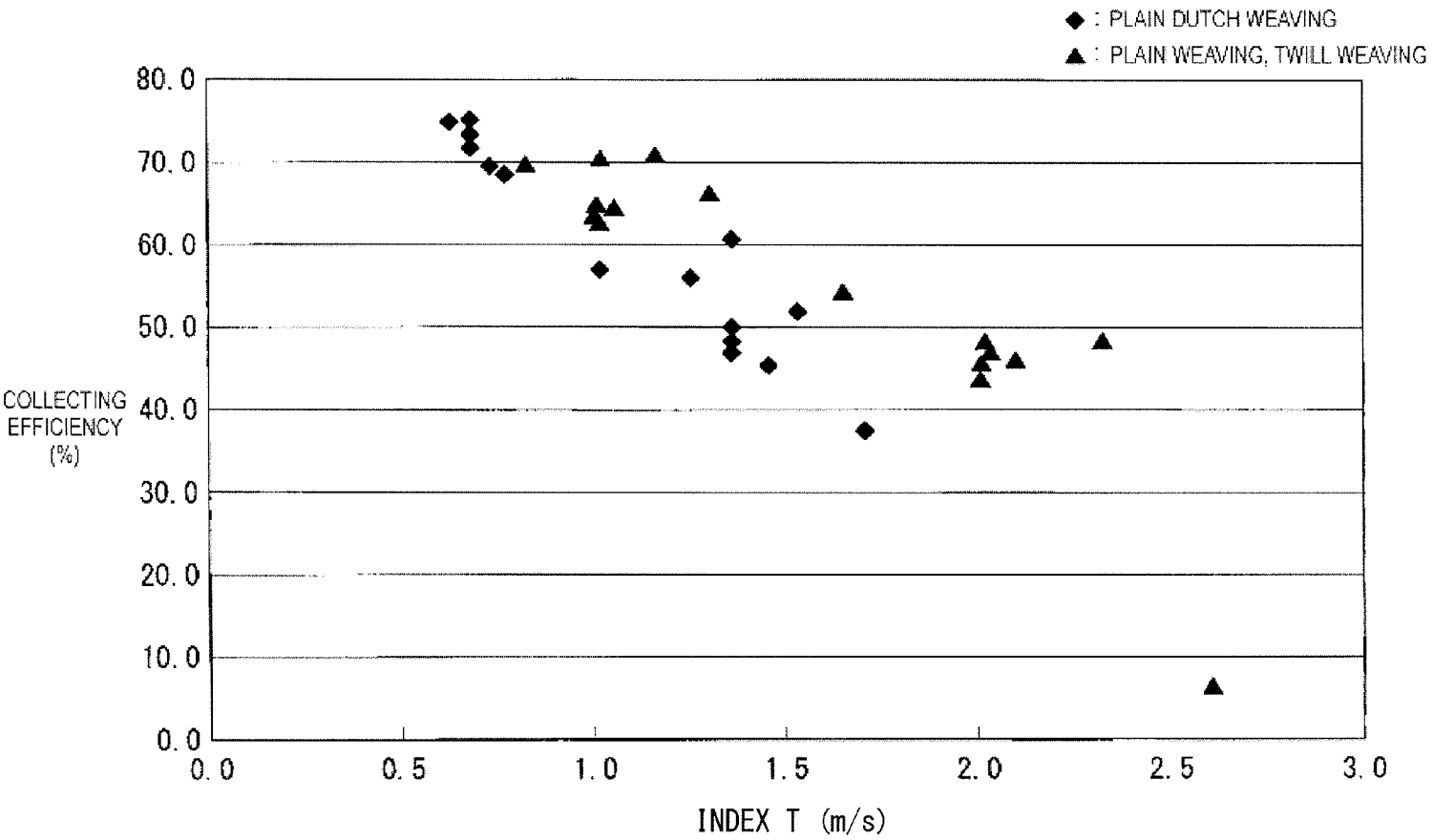
FIG. 7 is a graph showing a relationship between the collecting efficiency and IndexT.

Further, when a relationship between IndexT, which is a value obtained by multiplying the non-dimensional number IndexT' by the gas face velocity, and the collecting efficiency is shown in a graph, a graph shown in FIG. 7 is obtained. Based on this graph, it is easier to estimate the collecting efficiency.

More specifically, when the wire mesh satisfies equations (1) and (2) below and the gas face velocity v of penetrating the wire mesh is selected so as to be v=not less than 0.1 m/s, the collecting efficiency becomes approximately not less than 50%:

$$\text{Index}T=(\text{inter-wire distance}=2)=\text{opening ratio}=\text{wire diameter}\times\text{gas face velocity,} \quad (1)$$

$$\text{Index}T\leq 2 \quad (2)$$

where the opening ratio is a value obtained by an opening area of the wire mesh÷a plane area of the wire mesh. The gas face velocity is a value obtained by an amount of gas÷the plane area of the wire mesh.

Further, in equation (2), where IndexT≤1.5, for example, the collecting efficiency becomes approximately not less than 60%. Where IndexT≤1.0, for example, the collecting efficiency becomes approximately not less than 70%. More specifically, the smaller IndexT is, the more the collecting efficiency can be improved.

Note that, depending on the weaving method of the wire mesh (plain weaving, twill weaving, plain dutch weaving, or the like), different calculation methods are used for the inter-wire distance and the opening ratio.

Figure 8:
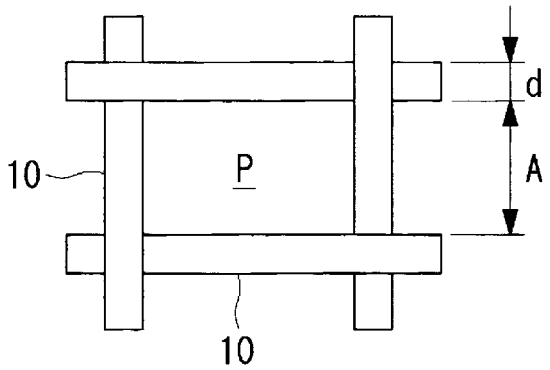
FIG. 8 is an enlarged plan view illustrating a plain-woven or twill-woven wire mesh.

When a plain-woven or twill-woven wire mesh, or the like is used, the inter-wire distance is set as a minimum aperture A of the opening which the gas penetrates. As illustrated in FIG. 8, when the opening has long sides and short sides, a length of the short side is the inter-wire distance.

When the plain-woven or twill-woven wire mesh, or the like is used, the aperture A (mm) is expressed as:

$$A\ (\text{mm})=(\text{wire pitch of the wire mesh})-(\text{wire diameter})=25.4/\text{MESH}-d,$$

and the opening ratio c (%) is expressed as:

$$\epsilon(\%)=\{(\text{opening area})/(\text{wire mesh area})\}\times 100=\{(\text{the square of the aperture})/(\text{the square of the pitch})\}\times 100=(A/(A+d))^2\times 100.$$

Figure 9:
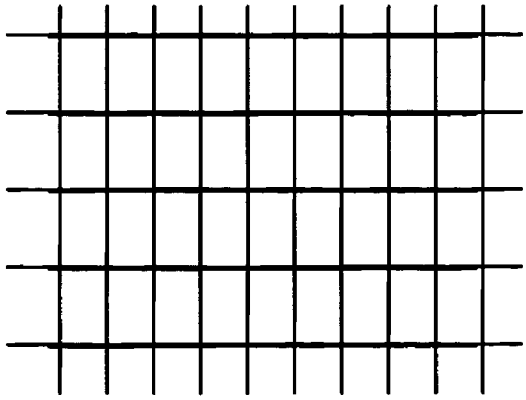
FIG. 9 is a plan view illustrating two superimposed sheets of the plain-woven wire mesh.
Figure 10:
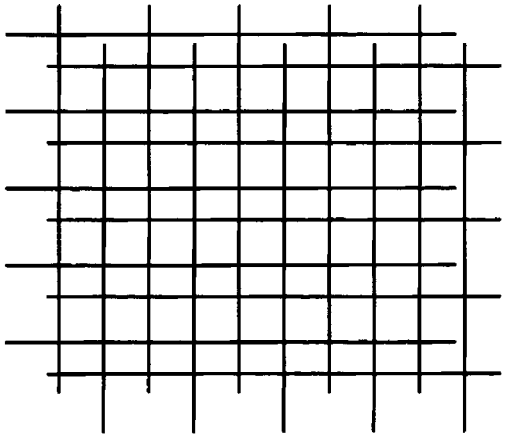
FIG. 10 is a plan view illustrating the two superimposed sheets of the plain-woven wire mesh.

As illustrated in FIG. 9 and FIG. 10, even when a plurality of plain-woven wire meshes, such as two sheets of the plain-woven wire mesh, are superimposed on one another, the opening ratio can be calculated in the same manner. FIG. 9 illustrates an example in which the plain-woven wire meshes are displaced in the Y direction. FIG. 10 illustrates an example in which the plain-woven wire meshes are displaced in the X direction and the Y direction.

Figure 11:
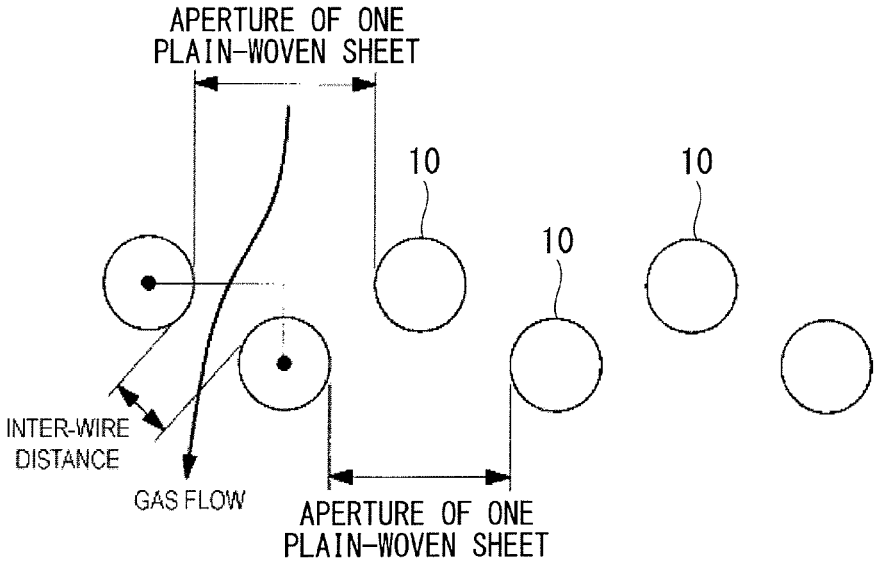
FIG. 11 is a cross-sectional view illustrating the two superimposed sheets of the plain-woven wire mesh.
Figure 13:
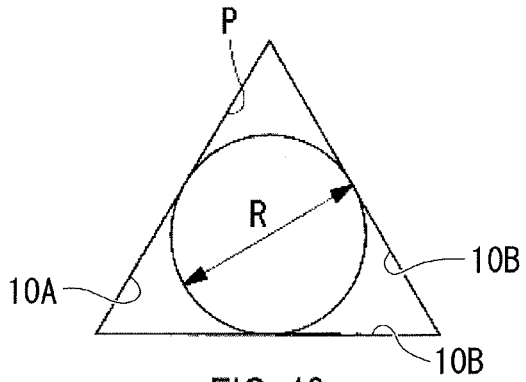
FIG. 13 is a schematic view illustrating an opening of the plain dutch woven wire mesh and a penetrating spherical particle.

As illustrated in FIG. 11, the inter-wire distance of the two plain-woven sheets is calculated based on the aperture of the one plain-woven sheet and a distance between the wires on each layer, the distance being generated when the plurality of wire meshes are superimposed on one another.

Figure 12:
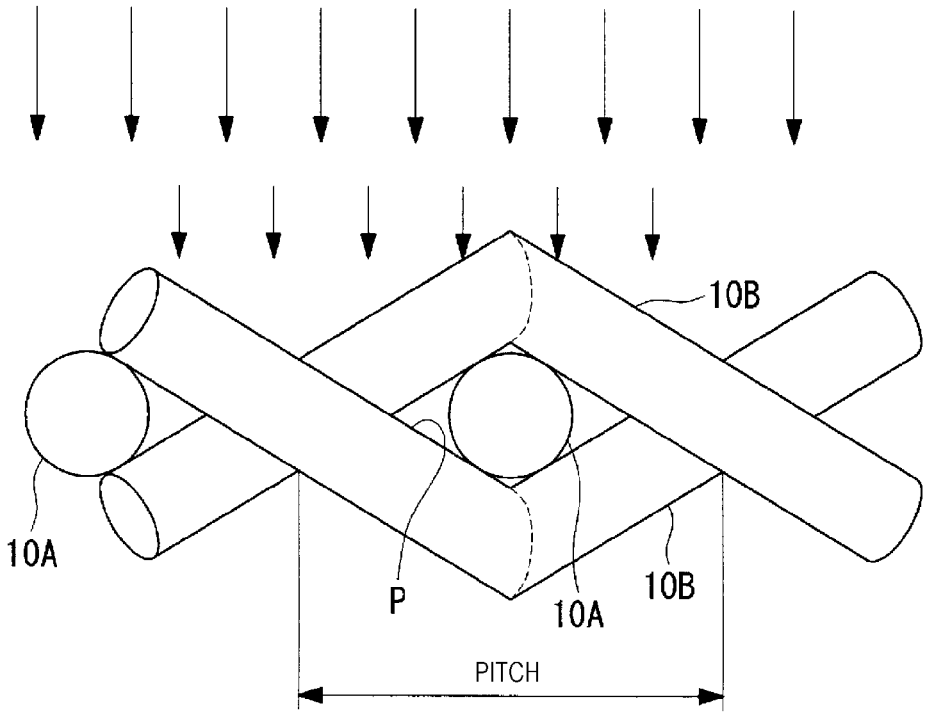
FIG. 12 is a cross-sectional view of a plain dutch woven wire mesh.

When a plain dutch woven wire mesh, or the like is used, the inter-wire distance is set as a particle diameter R of a penetrating spherical particle (a reference value), the penetrating spherical particle being a characteristic of the plain dutch woven wire mesh. Further, when the opening ratio c (%) is obtained, an area which a particle penetrates is defined as (an equilateral triangle derived from the diameter of the penetrating spherical particle×4), while noting that there are four openings P (equilateral triangles) between pitches (see FIG. 12) of thin wires 10A and between two thick wires 10B. Therefore, the opening ratio c (%) is expressed as:

$$\epsilon\ (\%)=(\text{area which the particle penetrates})/(\text{wire mesh area})=(\text{equilateral triangle derived from the penetrating spherical particle}\times 4)/\{(\text{wire diameter of the thin wire}\times 2)\times(25.4\div\text{mesh pitch of the thick wire})\}.$$

When the diameter of the penetrating spherical particle is defined as R, an area of the equilateral triangle is expressed as:

$$\text{base}\sqrt{3}R\times\text{height}\ 3R/2\div 2=(3\sqrt{3}\times R^2)/4.$$

For example, when a plain dutch woven 50 mesh is used, the opening ratio ϵ (%) is expressed as:

$$\epsilon(\%)=\{(3\sqrt{3}\times 0.36^2)/4\times 4\}\times\{(0.55\times 2)\times(25.4\div 10)\}\times 100=24.1\%,\ \text{and}$$

when a plain dutch woven 100 mesh is used, the opening ratio ϵ (%) is expressed as:

$$\epsilon(\%)=\{(3\sqrt{3}\times 0.2^2)/4\times 4\}\times\{(0.28\times 2)\times(25.4\div 16)\}\times 100=23.4\%.$$

As described above, according to the present embodiment, when, for example, the exhaust gas containing the particulate material is introduced, as a result of the corona discharge being generated by the discharge electrode, the particulate material contained in the exhaust gas is ionized, and the ionized particulate material is collected by the collecting electrode. Then, when the gas face velocity v of penetrating the wire mesh is such that v=not less than 0.1 m/s, it is desirable that the wire mesh satisfies equations (1) and (2) below:

$$\text{Index}T=(\text{inter-wire distance}\div 2)\div\text{opening ratio}\div\text{wire diameter}\times\text{gas face velocity}, \quad (1)$$

$$\text{Index}T\leq 2 \quad (2).$$

The equation (1) corresponds to the required horizontal dust migration velocity at a time when the dust approaches one of the wires in the horizontal direction, between two of the wires 10 of the wire mesh. Here, as described above, the required horizontal dust migration velocity is a velocity required for the dust to penetrate the dust adhering portion and to adhere to the wire mesh.

At this time, as a result of the wire mesh satisfying equations (1) and (2), wire surfaces of the wire mesh in the planar member 6 of the collecting electrode 3 have suitable conditions for the dust to adhere thereto, and the collecting efficiency of the collecting electrode 3 is improved.

REFERENCE SIGNS LIST

1 Dust collector
2 Discharge electrode
3 Collecting electrode
4 Casing
5 Mounting frame
6 Planar member
7 Filter material
8 Discharge spike
14 Discharge electrode support member

The invention claimed is:

1. A dust collector comprising:

a discharge electrode configured to have a voltage applied thereto; and a collecting electrode having a planar member formed of a wire mesh and disposed facing the discharge electrode; wherein the wire mesh of the planar member satisfies equations (1) and (2) below, and a gas face velocity v of penetrating the wire mesh is such that v=not less than 0.1 m/s:

$$\text{Index}T=(\text{inter-wire distance}\div 2)\div\text{opening ratio}+\text{wire diameter}\times\text{gas face velocity } v, \quad (1)$$

$$\text{Index}T\leq 2, \quad (2)$$

wherein a unit of IndexT is m/s, wherein, when the wire mesh is a plain-woven or twill-woven wire mesh, the inter-wire distance is set as a minimum aperture A of an opening which gas penetrates, the aperture A being expressed as: A=(wire pitch of the wire mesh)−(wire diameter), or when the wire mesh is a plain dutch woven wire mesh, the inter-wire distance is set as a particle diameter R of a penetrating spherical particle, wherein, when the wire mesh is the plain-woven or twill-woven wire mesh, the opening ratio is a value obtained by (opening area of the wire mesh)/(area of the wire mesh), or when the wire mesh is the plain dutch woven wire mesh, the opening ratio is a value obtained by (area which the particle penetrates)/(area of the wire mesh), wherein the gas face velocity v is a value obtained by (amount of gas)/(area of the wire mesh).

2. The dust collector according to claim 1, further comprising a filter material that is disposed on a surface side of the collecting electrode opposite to a surface of the collecting electrode facing the discharge electrode.

3. A method of electrode selection for a dust collector, the dust collector including a discharge electrode configured to have a voltage applied thereto and a collecting electrode having a planar member formed of a wire mesh and disposed facing the discharge electrode, the method comprising the step of:

performing a selection of the wire mesh so that the wire mesh of the planar member satisfies equations (1) and (2) below, and a gas face velocity v of penetrating the wire mesh is such that v=not less than 0.1 m/s:

$$\text{Index}T=(\text{inter-wire distance}\div 2)\div\text{opening ratio}\div\text{wire diameter}\times\text{gas face velocity } v, \quad (1)$$

$$\text{Index}T\leq 2, \quad (2)$$

wherein a unit of IndexT is m/s, wherein, when the wire mesh is a plain-woven or twill-woven wire mesh, the inter-wire distance is set as a minimum aperture A of an opening which gas penetrates, the aperture A being expressed as: A=(wire pitch of the wire mesh)−(wire diameter), or when the wire mesh is a plain dutch woven wire mesh, the inter-wire distance is set as a particle diameter R of a penetrating spherical particle, wherein, when the wire mesh is the plain-woven or twill-woven wire mesh, the opening ratio is a value obtained by (opening area of the wire mesh)/(area of the wire mesh), or when the wire mesh is the plain dutch woven wire mesh, the opening ratio is a value obtained by (area which the particle penetrates)/(area of the wire mesh), wherein the gas face velocity v is a value obtained by (amount of gas)/(area of the wire mesh).

4. A dust collection method comprising the step of collecting particulate material using a dust collector, the dust collector including a discharge electrode configured to have a voltage applied thereto and a collecting electrode having a planar member formed of a wire mesh and disposed facing the discharge electrode, wherein the wire mesh of the planar member satisfies equations (1) and (2) below, and a gas face velocity v of penetrating the wire mesh is such that v=not less than 0.1 m/s:

$$\text{Index}T=(\text{inter-wire distance}\div 2)\div\text{opening ratio}\div\text{wire diameter}\times\text{gas face velocity } v, \quad (1)$$

$$\text{Index}T\leq 2, \quad (2)$$

wherein a unit of IndexT is m/s, wherein, when the wire mesh is a plain-woven or twill-woven wire mesh, the inter-wire distance is set as a minimum aperture A of an opening which gas penetrates, the aperture A being expressed as: A=(wire pitch of the wire mesh)−(wire diameter), or when the wire mesh is a plain dutch woven wire mesh, the inter-wire distance is set as a particle diameter R of a penetrating spherical particle, wherein, when the wire mesh is the plain-woven or twill-woven wire mesh, the opening ratio is a value obtained by (opening area of the wire mesh)/(area of the wire mesh), or when the wire mesh is the plain dutch woven wire mesh, the opening ratio is a value obtained by (area which the particle penetrates)/(area of the wire mesh), wherein the gas face velocity v is a value obtained by (amount of gas)/(area of the wire mesh).

* * * * *